US005932834A

United States Patent [19]

Lyon et al.

[11] Patent Number: 5,932,834

[45] Date of Patent: Aug. 3, 1999

[54] AUTO-DESTRUCT FUZE

[75] Inventors: Charles Scott Lyon, Wharton; Homesh Lalbahadur, East Hanover, both of N.J.

[73] Assignee: The United States of America as represented by the Secretary of the Army, Washington, D.C.

[21] Appl. No.: 09/038,710

[22] Filed: Mar. 9, 1998

Related U.S. Application Data

[60] Provisional application No. 60/059,692, Sep. 22, 1997, and provisional application No. 60/044,804, Apr. 24, 1997.

[51] Int. Cl.[6] ..... F42C 15/184

[52] U.S. Cl. ..... 102/226; 102/228; 102/229; 102/255; 102/256; 102/259; 102/268

[58] Field of Search ..... 102/225, 226, 102/228, 229, 254, 255, 256, 258, 259, 260, 266, 268, 396

[56] References Cited

U.S. PATENT DOCUMENTS

| | | | |
|---|---|---|---|
| H1266 | 12/1993 | Zacharin | 102/255 |
| 3,601,060 | 8/1971 | Thuen | 102/266 |
| 4,078,496 | 3/1978 | Kruger et al. | 102/226 |
| 4,653,401 | 3/1987 | Gatti | 102/226 |
| 4,998,476 | 3/1991 | Rudenauer et al. | 102/226 |
| 5,048,419 | 9/1991 | Skowasch | 102/226 |
| 5,275,101 | 1/1994 | Chemiere et al. | 102/235 |
| 5,373,790 | 12/1994 | Chemiere et al. | 102/226 |
| 5,549,047 | 8/1996 | Borgni | 102/256 |
| 5,670,736 | 9/1997 | Chemiere et al. | 102/254 |

*Primary Examiner*—Harold J. Tudor
*Attorney, Agent, or Firm*—John Moran; Michael C. Sachs

[57] ABSTRACT

The Auto-destruct fuze is a mechanism that provides a primary mode detonator and a delayed auto-destruct/self-neutralize mode detonator function for a grenade or similar munition. The mechanics for the primary mode detonation is similar to the M223 fuze which the present invention is designed to replace. Operation of the auto-destruct/self-neutralize mode is based on the working principles of the Liquid Annular Orifice Device (LAOD). The LAOD is released from a locked position upon expulsion of the device from a storage container. The LAOD moves slowly under the urging of a spring and eventually releases a cleanup firing pin which activates a cleanup detonator to auto-destruct or self-neutralize the grenade.

4 Claims, 2 Drawing Sheets

AUTO-DESTRUCT FUZE

This application is a continuation-in-part of application Ser. No. 60/059,692 fd. Sep. 22, 1997 & 60/044,804 fd. Apr. 24, 1997 the entire file wrapper contents of which applications are herewith incorporated by reference as though fully set forth herein at length.

U.S. GOVERNMENT INTEREST

The invention described herein may be manufactured, used, and licensed by or for the U.S. Government for U.S. Government purposes.

BACKGROUND

This invention relates to fuzes which provide a primary mode of detonation and an auto-destruct (self-destruct)/self-neutralize capability for submunitions. More specifically, this invention relates to a low-cost auto-destruct fuze which automatically self-destructs or self-neutralizes if the primary mode of detonation fails.

The currently used M223 fuze has a five percent failure rate (dud rate).

The failure rate is both an environmental and a humanitarian hazard.

The conventional method for solving the problem of dud detonators is for the Explosives Ordnance Disposal (EOD) Personnel to locate the duds and to detonate them in place. This method poses a serious hazard to human life. In addition it is an inefficient method because it is costly, time consuming, and many of the duds are never recovered. Since the failure rate is five percent, this method is unsatisfactory.

Another more specific method for solving the problems of dud M223 fuzes was the design of a mechanical self-destruct fuze (XM223).

However, initial tests of the mechanical self-destruct fuze proved it to be unreliable. Therefore, no advantages were gained because the EOD method would still be required.

Yet another specific method developed to address the problems associated with the dud M223 fuzes was the development of the electronic fuze (XM234/XM235). The electronic fuze adequately decreases the high failure rate of the M223 fuzes. However, the electronic fuze has a very high anticipated production cost. In addition, the electronic fuzes require a power supply. This raises concerns regarding battery capacity for operation and requires additional monitoring to ensure proper operation of the unit when required. The additional required monitoring of the batteries adds operation costs to an already high production cost.

OBJECTS AND SUMMARY OF THE INVENTION

It is an object of the present invention to provide a self-destructing/self-neutralizing fuze which overcome the drawbacks of the prior art.

It is another object of the present invention to provide an self-destruct/self-neutralizing fuze which has a lower production cost than the prior art.

It is yet another object of the present invention to provide a self-destructing/self-neutralizing fuze which reduces the failure rate of the M223 fuze.

Briefly, the Auto-destruct fuze is a mechanism that provides a primary mode detonator and a delayed auto-destruct/self-neutralize mode detonator function for a grenade or similar munition. The mechanics for the operation of the auto-destruct/self-neutralize mode is based on the working principles of the Liquid Annular Orifice Device (LAOD). The LAOD is released from a locked position upon expulsion of the device from a storage container. The LAOD moves slowly under the urging of a spring and eventually releases a cleanup firing pin which activates a cleanup detonator to auto-destruct or self-neutralize the grenade.

According to an embodiment of the present invention, there is disclosed, an auto-destruct fuze mechanism for a munition, comprising: a base, a sliding portion slidably mounted on said base, a cleanup detonator mounted in said sliding portion, a cleanup firing pin movably mounted in said sliding portion, said cleanup firing pin being movable between first position and an activate position where said cleanup firing pin contacts said cleanup detonator, a Liquid Annular Orifice Device (LAOD) positioned at a locked position in said auto-destruct fuze, a interlock ball mounted in said sliding portion between said cleanup firing pin at said first position and said LAOD at said locked position, said LAOD at said locked position holding said interlock ball against said cleanup firing pin and said interlock ball holding said firing pin in a first position in said auto-destruct fuze, a first spring urging said LAOD toward an outer position in said auto-destruct fuze, a retainer holding said LAOD at said locked position when said munition is in a storage container and releasing said LAOD when said munition is released from said storage container, said interlock ball being released when said LAOD reaches said outer position under the urging of said first spring, thereby releasing said cleanup firing pin from said first position, and a second spring urging said cleanup firing pin toward said activate position to activate said cleanup detonator.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT(S)

Figure 1:
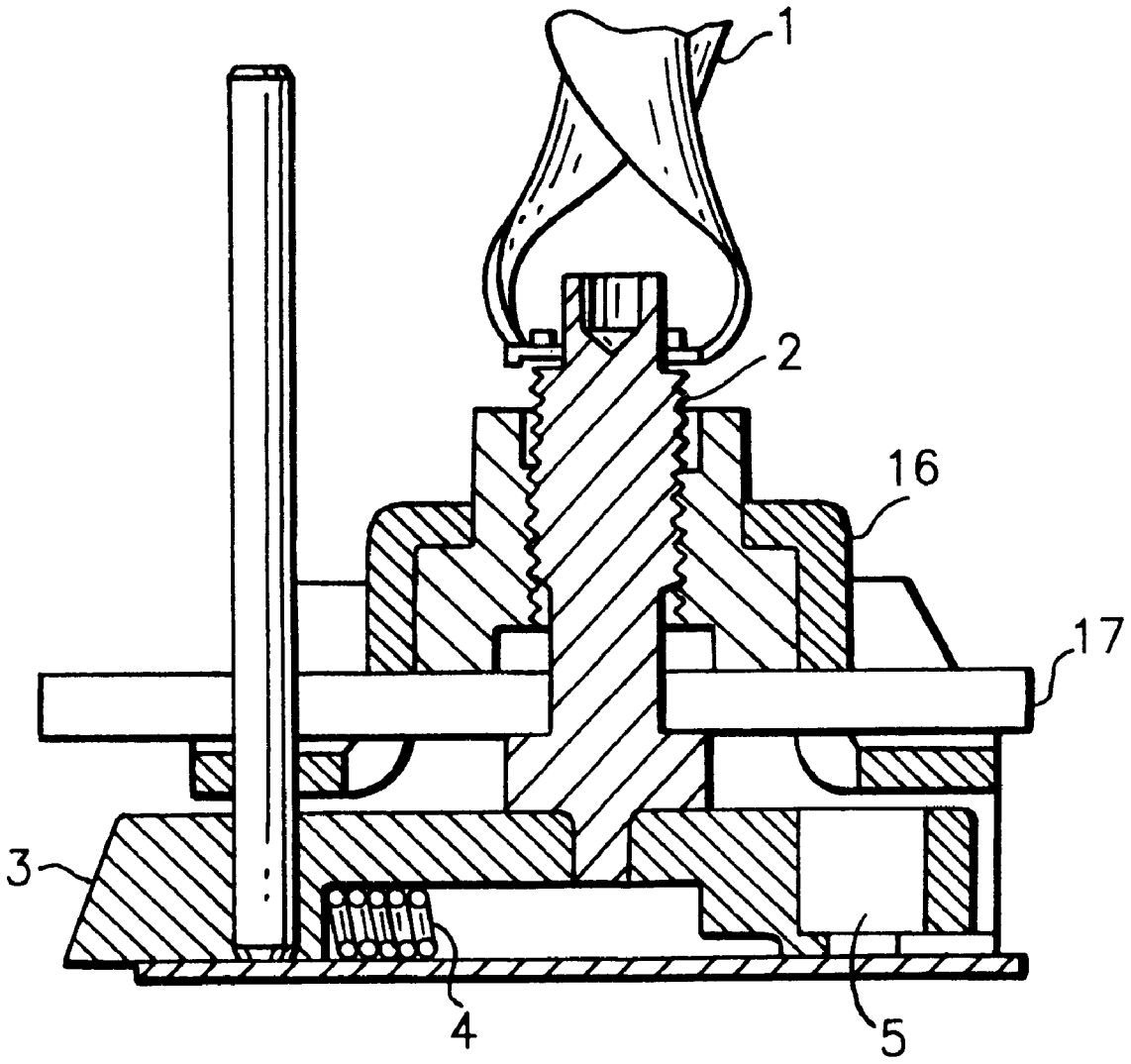
FIG. 1 is a cutaway view of the auto-destruct fuze of the present invention showing the primary mode detonator components.

Referring to FIG. 1, a housing assembly 16 is mounted on top of a grenade (not shown) or another munition to be detonated. The grenades are stored in a container until it is time to use them. The primary mode of detonation is initiated immediately after expulsion of the grenade from the container which was holding the grenades. The primary mode of detonation includes a ribbon stabilizer 1 extending from, the top of a housing assembly 16. After expulsion of the grenade from the container, ribbon stabilizer 1 orients the grenade with respect to the ground by acting as a drag as the grenade falls toward its target. Ribbon stabilizer 1 is connected to a firing pin 2. Firing pin 2 is screwed into the top of housing assembly 16. When firing pin 2 is screwed into housing assembly 16, it engages a slider 3 which is horizontally inserted into the bottom of housing assembly 16. Ribbon stabilizer 1 is shaped such that it rotates after expulsion and unscrews firing pin 2. When firing pin 2 is unscrewed it is freed from slider 3 and is free to move between an upper position and a lower position. The unlocked slider 3 is forced radially outward by an arming spring 4 and centrifugal force caused by the spinning of the grenade during its flight toward the target. When slider 3 is in a fully outward position, detonator 5 is aligned with firing pin 2. Upon impact with the ground, firing pin 2 impacts detonator 5, initiating an explosive train which detonates the grenade. If detonator 5 is defective, or if firing pin 2 did not impact detonator 5 properly, the explosive train will not be initiated leaving a live grenade on the battlefield.

Figure 2:
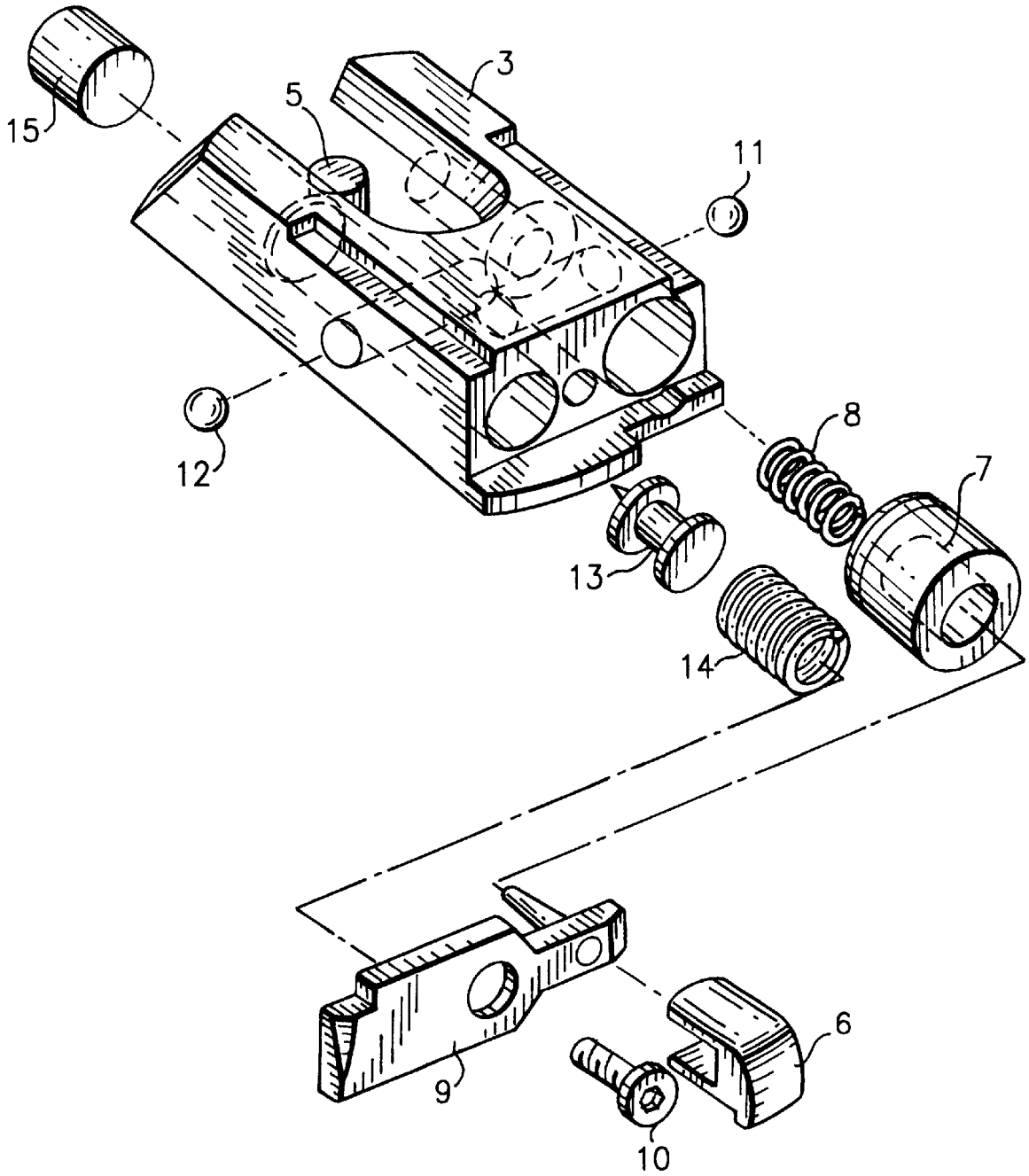
FIG. 2 is a perspective view of a slider of the auto-destruct fuze of the present invention showing the components of the auto-destruct/self-neutralization mode.

Referring now to FIG. 2, slider 3 contains a cleanup detonator 15. A cleanup firing pin 13 is located adjacent to cleanup detonator 15. Cleanup firing pin 13 is urged toward cleanup detonator 15 by a cleanup spring 14. A first interlock ball 12 located in slider 3 engages an annular gap in cleanup firing pin 13 which prevents firing pin 13 from impacting cleanup detonator 15.

A time delay for activating cleanup detonator includes a liquid annular orifice device (LAOD) 7. LAOD 7 has a spherical piston which moves within a closed end cylinder forcing a liquid to flow through the clearance between the piston and cylinder. LAOD 7 is located in slider 3 to hold a second interlock ball 11 in place. A push spring 8 urges LAOD 7 out of slider 3. However, a bore rider retainer 6 holds LAOD 7 in place. Bore rider retainer 6 is secured by a grenade directly above it when the grenades are held in their storage container. When the grenades are released, bore rider retainer 6 falls off of slider 3 and the urging of push spring 8 begins to move LAOD 7. The cylinder portion of LAOD 7 is held in place by a projection on a plate pin 9. Plate pin 9 is secured to slider 3 by a plate pin fastener 10. Due to the nature of LAOD 7, the urging of push spring 8 is resisted and LAOD 7 moves very slowly toward plate pin 9.

If the primary mode of detonation does not activate detonator 5, LAOD 7 continues to slowly move toward plate pin 9. At some point in its movement, LAOD 7 no longer retains second interlock ball 11 resulting in both first interlock ball 12 and second interlock ball 11 being released from slider 3. The release of first interlock ball 12 frees cleanup firing pin 13. The urging of cleanup spring 14 propels cleanup firing pin 13 into contact with cleanup detonator 15. The output of cleanup detonator 15 is channeled to activate detonator 5.

If slider 3 is in the armed position, that is if detonator 5 is directly beneath firing pin 2, the explosive train for the grenade will be initiated for auto destruction (self-destruction). If the slider is in the unarmed position, that is if detonator 5 is not beneath firing pin 2, the grenade will be sterilized meaning all of the primary explosives will have been eliminated. In the preferred embodiment, the release of first interlocking ball 12 and second interlocking ball 11 occurs between one and eight minutes after the release of the grenade from its storage container. This allows ample time for the primary mode of detonation to be initiated by the grenade striking its target. This time period also quickly removes duds from the battlefield such that cleanup can begin promptly.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

For instance, in the preferred embodiment, there are two interlock balls. It is possible to practice the invention with only one interlock ball or a plurality of interlock balls could be used. Also, in the preferred embodiment, the LAOD includes a spherical piston. Any shaped piston will perform the function.

What is claimed is:

1. An auto-destruct fuze mechanism for a munition, comprising:

a base;

a sliding portion slidably mounted on said base;

a primary mode detonator mounted on said sliding portion;

a primary firing pin movably connected to said base to detonate said primary mode detonator upon impact of said munition with a target;

a cleanup detonator mounted in said sliding portion;

a cleanup firing pin movably mounted in said sliding portion, said cleanup firing pin being movable between a first position and an activate position where said cleanup firing pin contacts said cleanup detonator;

a Liquid Annular Orifice Device (LAOD) positioned at a locked position in said sliding position;

a interlock ball mounted in said sliding portion between said cleanup firing pin at said first position and said LAOD at said locked position, said LAOD at said locked position holding said interlock ball against said cleanup firing pin and said interlock ball holding said cleanup firing pin in a first position in said auto-destruct fuze;

a first spring urging said LAOD toward an outer position in said auto-destruct fuze;

a retainer holding said LAOD at said locked position when said munition is in a storage container and releasing said LAOD when said munition is released from said storage container;

said interlock ball being released when said LAOD reaches said outer position under the urging of said first spring, thereby releasing said cleanup firing pin from said first position; and a second spring urging said cleanup firing pin toward said activate position to activate said cleanup detonator.

2. The auto-destruct fuze of claim 1, wherein said slider is movable between and armed position where said primary mode detonator is directly under said primary firing pin and an unarmed position where said primary mode detonator is not in the path of said primary firing pin.

3. The auto-destruct fuze of claim 2, wherein a direction of urging of said first spring and a direction of urging of said second spring are perpendicular to a direction of movement of said primary firing pin such that a profile of said slider in said direction of movement of said primary firing pin is as small as possible.

4. The auto-destruct fuze of claim 2, wherein:

an output of cleanup detonator is channeled to activate said primary detonator;

when said slider is in said armed position, activation of said cleanup detonator initiates a self destruction of said munition; and when said slider is in said unarmed position, activation of said cleanup detonator initiates a self neutralization of said munition by eliminating said cleanup detonator and said primary detonator.

* * * * *